United States Patent [19]

Tsuchiya

[11] 4,362,985

[45] Dec. 7, 1982

[54] INTEGRATED CIRCUIT FOR GENERATING A REFERENCE VOLTAGE

[75] Inventor: Chikara Tsuchiya, Tokyo, Japan

[73] Assignee: Fujitsu Limited, Kawasaki, Japan

[21] Appl. No.: 255,038

[22] Filed: Apr. 17, 1981

[30] Foreign Application Priority Data

Apr. 18, 1980 [JP] Japan ..... 55-51399

[51] Int. Cl.[3] ..... G05F 3/20

[52] U.S. Cl. ..... 323/314; 323/907; 330/296

[58] Field of Search ..... 307/296 R, 297; 323/311-314, 907; 330/296, 297

[56] References Cited

U.S. PATENT DOCUMENTS

| | | | |
|---|---|---|---|
| Re. 30,586 | 4/1981 | Brokaw | 323/314 |
| 3,794,861 | 2/1974 | Bernacchi | 323/907 |
| 3,886,435 | 5/1975 | Steckler | 323/315 |
| 4,091,321 | 5/1978 | Hanna | 323/314 |
| 4,122,403 | 10/1978 | Cave | 330/296 |
| 4,230,980 | 10/1980 | Sano et al. | 330/296 X |
| 4,283,674 | 8/1981 | Kominami et al. | 323/313 |

FOREIGN PATENT DOCUMENTS 2281603 3/1976 France .

OTHER PUBLICATIONS

Brokaw, "A Simple Three-Terminal IC Bandgap Reference", IEEE Journal of Solid-State Circuits, vol. SC-9, No. 6, Dec. 1974, pp. 388-393.

*Primary Examiner*—A. D. Pellinen
*Attorney, Agent, or Firm*—Staas & Halsey

[57] ABSTRACT

A circuit for generating a reference voltage including a first transistor and a second transistor of which the bases being commonly connected together. The area of the emitter of the first transistor being smaller than the area of the emitter of the second transistor, the emitter of the first transistor being connected to the ground, and the emitter of the second transistor being connected to the ground via a first resistor. The circuit also includes a current supply means which supplies an equal current to the collectors of the first and second transistors and a second resistor which is connected between an output terminal and a connection point of the commonly connected bases of the first and second transistors. The circuit additionally includes a current generator circuit which is connected between the connection point of the commonly connected bases and the ground to produce a current which is proportional to the emitter current of the first transistor or the second transistor, such that a constant voltage is generated at the output terminal.

10 Claims, 10 Drawing Figures

INTEGRATED CIRCUIT FOR GENERATING A REFERENCE VOLTAGE

BACKGROUND OF THE INVENTION

The present invention relates to a circuit for generating a reference voltage, and more specifically to an integrated circuit for generating a reference voltage which is in agreement with a band gap of a semiconductor material that forms the transistor and which assumes a predetermined value irrespective of the temperature.

The reference voltage must, usually, assume a constant value independently of the temperature. This requirement can be satisfied by using a band-gap reference circuit. As represented, for example, by an integrated circuit LM 117 manufactured by National Semiconductor Co., the band-gap reference circuit consists of a first transistor and a second transistor of which the bases are commonly connected and which are supplied with an equal current from a current mirror circuit, the area of the emitter of the second transistor being N times greater than that of the first transistor. Further, a first resistor is connected to the emitter of the second transistor, and a connection point between the other end of the first resistor and the emitter of the first transistor is grounded via a second resistor. The collector voltage of the first transistor, on the other hand, is fed back to the power supply of the current mirror circuit via a feedback amplifier, and the output voltage is taken out from the base potential of the first and second transistors.

In such a conventional circuit for generating the reference voltage, the potential of the power supply for supplying a current to the current mirror circuit must be higher than the collector potential of the first transistor. When the reference voltage is 1.2 volts, the potential of the power supply of the current mirror circuit must be greater than 2.1 volts at room temperature. The potential of the power supply of the current mirror circuit is supplied from the power supply of the feedback amplifier. Therefore, the feedback amplifier requires a higher power-supply voltage. The requirement of such a high power-supply voltage is not desirable for integrated circuits.

SUMMARY OF THE INVENTION

The object of the present invention is to provide a reference voltage generator circuit which operates on a small power-supply voltage.

Another object of the present invention is to provide a reference voltage generator circuit which can be suitably obtained in the form of an integrated circuit.

The above objects of the present invention can be achieved by a circuit for generating a reference voltage, including: a first transistor and a second transistor of which the bases being commonly connected together. The area of the emitter of the first transistor being smaller than the area of the emitter of the second transistor, the emitter of the first transistor being connected to the ground, and the emitter of the second transistor being connected to the ground via a first resistor. The circuit also includes current supply means which supplies an equal current to the collectors of the first and second transistors and a second resister which is connected between an output terminal and a connection point of the commonly connected bases of the first and second transistors. The circuit additionally includes a current generator circuit which is connected between the connection point of the commonly connected bases and ground to produce a current which is proportional to the emitter current of the first transistor or the second transistor, so that a constant voltage is generated at the output terminal.

Further features and advantages of the present invention will become apparent from the ensuing description with reference to the accompanying drawings to which, however, the scope of the invention is in no way limited.

DESCRIPTION OF THE PREFERRED EMBODIMENTS

Figure 1:
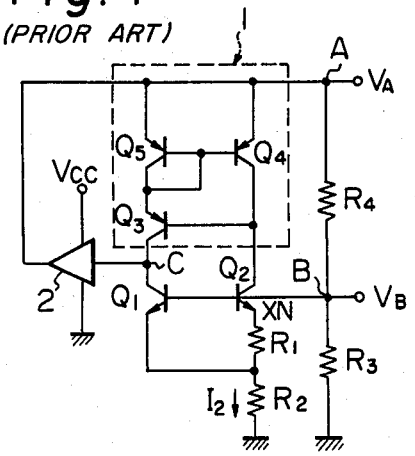
Fig. 1 (PRIOR ART)
FIG. 1 is a block diagram of a conventional band-gap reference circuit.

FIG. 1 shows a conventional band-gap reference circuit in which the feature resides in a pair of npn transistors $Q_1$ and $Q_2$ that produce a current proportional to the absolute temperature, and a resistor $R_1$. The transistors $Q_1$ and $Q_2$ of which the bases are commonly connected are supplied with an equal current from a current mirror circuit 1 comprising of pnp transistors $Q_3$ to $Q_5$, and the area of the emitter of the transistor $Q_2$ is N times greater than that of the transistor $Q_1$. One end of a first resistor $R_1$ is connected to the emitter of the transistor $Q_2$, and another end of the resistor $R_1$ and the emitter of the transistor $Q_1$ are grounded via a second resistor $R_2$. Therefore, the base potential of the transistors $Q_1$ and $Q_2$, i.e., a reference voltage $V_B$ at the output terminal B is given by, $$V_B = V_{BE1} + I_2 R_2 \tag{1}$$

where $V_{BE1}$ denotes a voltage across the base and emitter of the transistor $Q_1$, and $I_2$ denotes a current which flows through the resistor $R_2$.

If emitter currents of the transistors $Q_1$ and $Q_2$ are each denoted by $I_E$, there is the relation $I_2 = 2I_E$.

Since the transistors $Q_1$ and $Q_2$ have different emitter areas, the voltage $V_{BE2}$ across the base and emitter of the transistor $Q_2$ is different from the voltage $V_{BE1}$ across the base and emitter of the transistor $Q_1$. Namely, $$V_{BE1} = V_T l_n \frac{I_E}{I_S} \tag{2}$$

-continued $$V_{BE2} = V_T l_n \frac{I_E}{N \cdot I_S} \quad (3)$$

$$\text{where, } V_T = \frac{kT}{q}$$

where k denotes Boltzmann's constant, T denotes the absolute temperature, q denotes the electric charge of an electron, N denotes a ratio of emitter areas, and $I_S$ denotes a saturated current.

In the connection mode of FIG. 1, $$V_{BE1} = V_{BE2} + I_E \cdot R_1 \quad (4)$$

If relations (2) and (3) are inserted into the above relation (4), there is obtained the relation, $$I_E \cdot R_1 = V_{R1} = V_T l_n N \quad (5)$$

By using the above relation (5), the relation (1) can be rewritten as follows:

$$\begin{aligned} V_B &= V_{BE1} + 2I_E \cdot R_2 \\ &= V_{BE1} + 2V_{R1}\frac{R_2}{R_1} \\ &= V_{BE1} + 2 \cdot \frac{R_2}{R_1} V_T l_n N \end{aligned} \quad (6)$$

Figure 2:
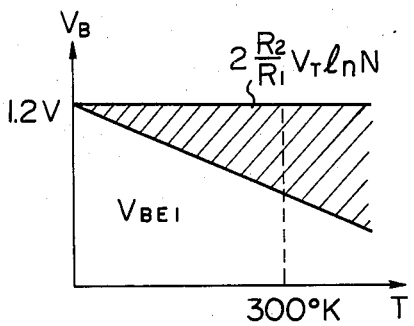
Fig. 2 (PRIOR ART)
FIG. 2 is a diagram which illustrates temperature characteristics of the band-gap reference circuit.

The temperature dependency, therefore, is as shown in FIG. 2. Namely, $V_{BE1}$ which is the first term on the right side of the relation (6) decreases with the increase in the temperature T, and $$2 \cdot \frac{R_2}{R_1} \cdot V_T l_n N$$

which is the second term increases with the rise in the temperature T. Therefore, if the changing ratios are equalized by adjusting $R_2/R_1$, the two values are cancelled by each other, and the reference voltage $V_B$ remains constant (compensated for the temperature). This constant value is nearly equal to a band-gap voltage (1.2 volts in the case of a silicon semiconductor) of a semiconductor material which forms transistors $Q_1$ and $Q_2$.

Here, if a voltage across the collector and emitter which does not saturate the transistor is denoted by $V_S$, the potential $V_A$ at a point A which supplies a current to the current mirror circuit 1 must assume a value which is greater than a potential $V_B - V_{BE1} + V_S$ at the collector (point C) of the transistor $Q_1$ by a quantity of two stages of $V_{BE}$ of the transistors $Q_3$ and $Q_5$, i.e., $$V_A \geqq V_B + V_{BE} + V_S \quad (7)$$

Practical values at room temperature are $V_B = 1.2$ V, $V_{BE} = 0.7$ V, and $V_S = 0.2$ V. Therefore, the relation $V_A \geqq 2.1$ V must hold true. The voltage $V_A$ is supplied from the power-supply voltage $V_{CC}$ of the feedback amplifier 2*a*. Therefore, requirement of a high voltage $V_A$ means that the power-supply voltage $V_{CC}$ must be high. Symbols $R_3$ and $R_4$ denote resistors of the output stage, which feed base currents to the transistors $Q_1$ and $Q_2$.

Figure 3:
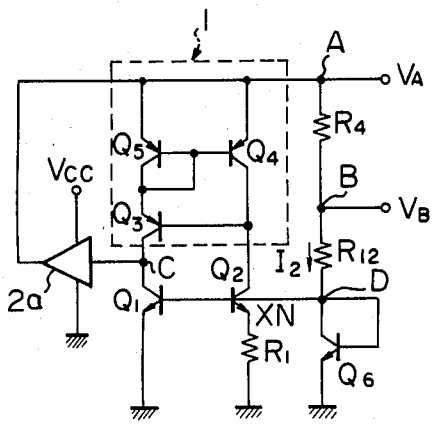
FIG. 3 is a block diagram illustrating the fundamental setup of a circuit for generating a reference voltage according to the present invention.

FIG. 3 is a circuit diagram illustrating a fundamental setup of the present invention, in which the same portions are denoted by the same symbols. What makes the circuit of FIG. 3 different from the circuit of FIG. 1 is that the second resistor $R_2$ is connected between the output terminal B and a point D where bases of the transistors $Q_1$, $Q_2$ are commonly connected; this resistor is denoted by $R_{12}$. Further, a transistor (or a diode) $Q_6$ is connected between the point D where the bases are commonly connected and ground, so that the electric current $I_2$ will flow through the second resistor $R_{12}$ in proportion to the absolute temperature. The transistor $Q_6$ forms a current mirror circuit together with the transistor $Q_1$. It is therefore possible to flow an electric current which is proportional to the ratio of emitter areas of the two transistors. In other words, it is possible to adjust the current flowing through the resistor $R_{12}$ to become equal to the current $I_2$ of FIG. 1. Consequently the above-mentioned relation (1) holds true even with the circuit of FIG. 3. Therefore, the temperature characteristics of $V_{BE1}$ of the transistor $Q_1$ are compensated by the temperature characteristics of voltage drop $I_2R_{12}$ across the resistor $R_{12}$, and the reference voltage $V_B(=1.2$ V) is maintained constant as shown in FIG. 2. Further, since the emitter of the transistor $Q_1$ can be grounded, the potential at the point C can be lowered to $V_S$, and the potential $V_A$ at the point A can be lowered to, $$V_A \geqq 2V_{BE} + V_S \quad (8)$$

If the aforementioned numerical figures are inserted $V_A \geqq 1.6$ V; i.e., the power-supply voltage $V_{CC}$ can be lowered by 0.5 V as compared with the case of the relation (7). As is well known, the power supply of the integrated circuits has a small voltage, and is often established by storage cells. Therefore, the decrease of the power-supply voltage by 0.5 volt gives such a great effect that the number of storage cells can be reduced, for example, from three to two.

Figure 4:
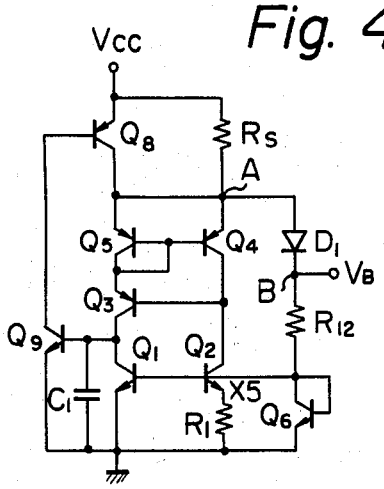
FIG. 4 is a circuit diagram of an embodiment of the block diagram of FIG. 3.

The resistor $R_4$ works to reduce the potential difference (1.6–1.2) V between $V_A$ and $V_B$. The resistor $R_4$, however, may be replaced by a diode or a transistor. FIG. 4 illustrates an embodiment of a circuit based upon the fundamental setup of FIG. 3, in which symbols $Q_8$ and $Q_9$ denote transistors which comprise an amplifier 2*a*, and $C_1$ denotes a capacitor for compensating the phase. Further, a resistor $R_S$ connected between the power supply $V_{CC}$ and the point A has a high resistance and works to start the operation. The emitter area of the transistor $Q_2$ is set to be, for example, 5 times ($\times 5$) that of the transistor $Q_1$. In the embodiment of FIG. 4, a potential difference of about 0.7 V is maintained between $V_A$ and $V_B$ by a diode $D_1$.

Figure 5:
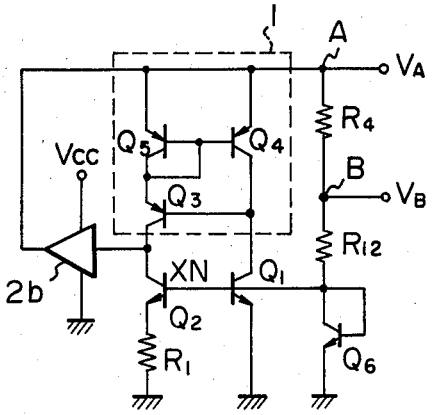
FIG. 5 is a block diagram illustrating another fundamental setup of the circuit for generating a reference voltage according to the present invention.
Figure 6:
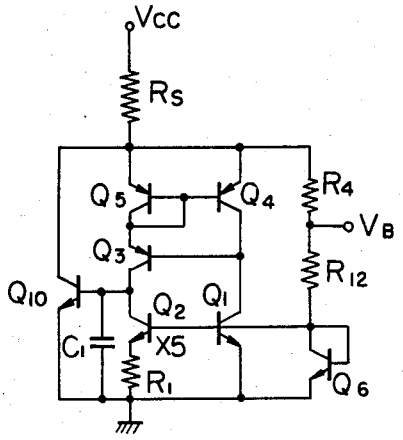
FIG. 6 is a circuit diagram of an embodiment of the block diagram of FIG. 5.

FIG. 5 illustrates a modified embodiment of the fundamental setup of FIG. 3. What makes the circuit of FIG. 5 different from the circuit of FIG. 3 is that a series circuit comprising the transistor $Q_2$ and the resistor $R_1$ is connected in series with the collector of the transistor $Q_3$, the collector of the transistor $Q_1$ is connected in series with the base of the transistor $Q_3$, and the feedback amplifier 2*b* is fed back to the potential $V_A$ from the collector of the transistor $Q_2$. In this case, the input phase and the output phase of the amplifier are reversed relative to each other. The principle of operation, functions and effects are quite the same as those in the case of FIG. 3. FIG. 6 illustrates an embodiment of the setup of FIG. 5, wherein a transistor $Q_{10}$ works as a feedback amplifier, and its output phase and the input phase are reversed relative to each other.

Figure 7:
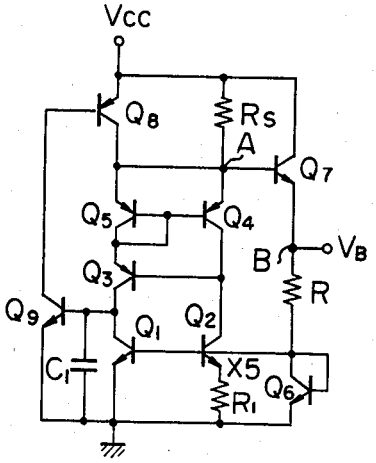
FIG. 7 is a circuit diagram of another embodiment of the circuit for generating a reference voltage of the present invention.
Figure 8:
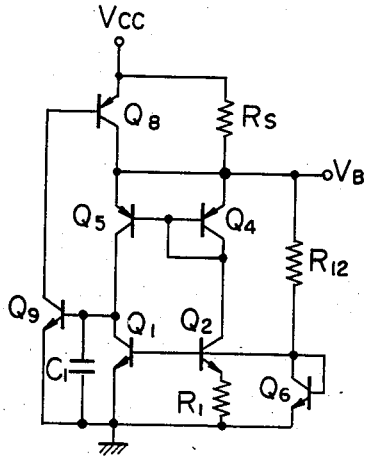
FIG. 8 is a circuit diagram of a further embodiment according to the present invention.

FIG. 7 illustrates a modified embodiment of FIG. 4, in which a transistor $Q_7$ is used in place of the resistor $R_4$ that is employed in FIG. 3, and transistors $Q_8$ and $Q_9$ form an amplifier. This circuit features a large output current since the transistor $Q_7$ is connected in a manner of emitter follower. FIG. 8 illustrates a further modified embodiment of FIG. 4. Namely, the circuit of FIG. 8 does not have the transistor $Q_3$ and the diode $D_1$ that are used in the circuit of FIG. 4, and requires a further decreased power-supply voltage $V_{CC}$.

Figure 9A:
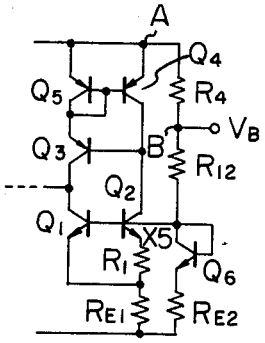
FIGS. 9A and 9B are circuit diagrams illustrating important portions of still further embodiments according to the present invention.
Figure 9B:
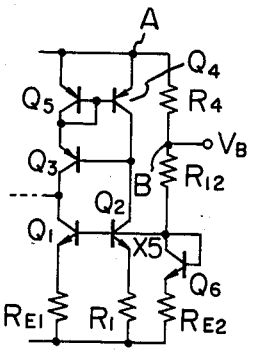

FIGS. 9A and 9B illustrate important portions of the embodiment of FIG. 3 when the offset compensation is effected. The reference voltage generator circuit of this type is constructed in the form of a semiconductor integrated circuit, and an offset voltage (usually on the order of several millivolts) is generated in the voltages $V_{BE}$ of the transistors $Q_1$ and $Q_6$. Symbols $R_{E1}$ and $R_{E2}$ are small resistances which are inserted in the side of the emitter to cancel the offset voltage. These resistances generate voltages which are sufficient to cancel the offset voltages.

According to the present invention as mentioned in the foregoing, the power-supply voltage of a band-gap reference circuit can be lowered, and the number of storage cells can be reduced from, for example, three to two. Or, even when the same number of storage cells are used, for example, even when two storage cells are used, the circuit can be operated maintaining sufficient margin.

I claim:

1. A circuit for generating a reference voltage, comprising:

a first resistor operatively connected to ground;

a first transistor and a second transistor each having bases commonly connected together at a first connection point, each having collectors and each having emitter regions, an area of the emitter region of the first transistor being smaller than an area of the emitter region of the second transistor, the emitter of the first transistor being connected to ground, and the emitter of the second transistor being connected to the first resistor at a second connection point;

current supply means, operatively connected to the collectors of the first and second transistors, for supplying an equal current to the collectors of the first and second transistors;

a second resistor operatively connected between an output terminal and the first connection point of the commonly connected bases of the first and second transistors;

a third resistor operatively connected between said output terminal and a first power supply point; and a current generator circuit, operatively connected between the first connection point of the commonly connected bases and ground, for generating a current which is proportional to the emitter current of the first transistor or the second transistor, such that a constant voltage is generated at the output terminal.

2. A circuit for generating a reference voltage according to claim 1, wherein said current supply means comprises:

a current mirror circuit operatively connected between the collectors of said first and second transistors and said first power supply point; and a feedback amplifier which is driven from a second power supply point having a voltage higher than that of said first power supply point and which is operatively connected between the collector of said first transistor and said first power supply point.

3. A circuit for generating a reference voltage according to claim 2, wherein said feedback amplifier comprises a positive-phase-sequence amplifier operatively connected between the collector of said first transistor and said first power supply point.

4. A circuit for generating a reference voltage according to claim 3, wherein said positive-phase-sequence amplifier comprises:

a third transistor having a base operatively connected to the collector of said first transistor, having a collector and having an emitter operatively connected to ground;

a fourth transistor having a base operatively connected to the collector of said third transistor, having an emitter operatively connected to said second power supply point and having a collector operatively connected to said first power supply point; and a fourth resistor operatively connected between said first power supply point and said second power supply point.

5. A circuit for generating a reference voltage according to claim 2, wherein said feedback amplifier comprises a negative-phase-sequence amplifier operatively connected between the collector of said second transistor and said first power supply point.

6. A circuit for generating a reference voltage according to claim 5, wherein said negative-phase-sequence amplifier comprises:

a third transistor having a base operatively connected to the collector of said second transistor, having an emitter operatively connected to ground, and having a collector operatively connected to said first power supply point; and a fourth resistor operatively connected between said first power supply point and said second power supply point.

7. A circuit for generating a reference voltage according to claim 4, further comprising a fifth transistor having a base operatively connected to said first power supply point, having a collector operatively connected to said second power supply point, and having an emitter operatively connected to said output terminal.

8. A circuit for generating a reference voltage according to any one of claims 1, 2, 3, 4, 5, 6, or 7, further comprising an offset resistor for offset compensation operatively connected between ground and the emitter of said first transistor and between said first resistor and ground.

9. A circuit for generating a reference voltage according to any one of claims 1, 2, 3, 4, 5, 6, or 7, further comprising an offset resistor for offset compensation operatively connected between the emitter of said first transistor and ground.

10. A circuit for generating a reference voltage, comprising:

a first transistor and a second transistor each having bases commonly connected together, each having an emitter region, each having collectors, an area of the emitter region of said second transistor being greater than that of said first transistor, and the emitter of said first transistor operatively grounded;

a first resistor operatively connected between said second transistor and ground;

a second resistor operatively connected between the base of said first transistor and an output terminal;

a third transistor and a fourth transistor each having collectors operatively connected to the collectors of said first and second transistors, respectively, each having emitters operatively connected to said output terminal, each having bases commonly connected together, and the base and collector of said fourth transistor being connected to each other;

a voltage generator circuit operatively connected between ground and the commonly connected bases of said first and second transistors;

a fifth transistor having a base operatively connected to the collector of said first transistor, having a collector and having an emitter operatively connected to ground;

a capacitor operatively connected between the base of said fifth transistor and ground;

a sixth transistor having a base operatively connected to the collector of said fifth transistor, having an emitter operatively connected to a power supply, and having a collector operatively connected to said output terminal; and a third resistor operatively connected between said power supply and said output terminal.

* * * * *

UNITED STATES PATENT AND TRADEMARK OFFICE

CERTIFICATE OF CORRECTION

PATENT NO. : 4,362,985

DATED : December 7, 1982

INVENTOR(S) : CHIKARA TSUCHIYA.

It is certified that error appears in the above-identified patent and that said Letters Patent is hereby corrected as shown below:

Column 1, line 54, delete ":".
Column 2, line 44, delete "of".

Signed and Sealed this

*Twenty-sixth* Day of *April 1983*

[SEAL]

*Attest:*

GERALD J. MOSSINGHOFF

*Attesting Officer*

*Commissioner of Patents and Trademarks*